US005626272A

United States Patent [19]

Klemansky

[11] Patent Number: 5,626,272

[45] Date of Patent: May 6, 1997

[54] DRYWALL PAK

[76] Inventor: Darryn M. Klemansky, 104 Marian Ave., Pittsfield, Mass. 01201

[21] Appl. No.: 497,379

[22] Filed: Jun. 30, 1995

[51] Int. Cl.[6] ..... A45F 3/00; B65D 3/00

[52] U.S. Cl. ..... 224/674; 224/232; 224/233; 224/904; 224/679; 224/680; 224/677; 206/362; 206/373; 220/695; 220/697

[58] Field of Search ..... 224/904, 252, 224/253, 232, 233, 234, 226, 148, 242, 907, 224; 206/362, 372, 373, 592; 220/695–702

[56] References Cited

U.S. PATENT DOCUMENTS

| | | |
|---|---|---|
| 2,719,313 | 10/1955 | Smith . |
| 3,428,988 | 2/1969 | Blackburn . |
| 4,087,878 | 5/1978 | Grieshaber . |
| 4,103,388 | 8/1978 | Devitis . |
| 4,734,952 | 4/1988 | Parchment . |
| 4,879,779 | 11/1989 | Zalevsky . |

*Primary Examiner*—Henry J. Recla
*Assistant Examiner*—Timothy L. Maust

[57] ABSTRACT

A Drywall tub device including a tub having sidewalls, endwalls, a bottom and a snap-down top, also including a belt attachment and three essential accessory attachments needed to perform the drywall task. The tub which includes the sidewalls, endwalls, bottom and a male snap-down locking tabs on each endwall is molded out of a thermoplastic compound or suitable substance. The hollow tub is used to hold a cleaning solution. The snap-down top is also molded from a thermoplastic compound or suitable substance having two female snap-locks molded into each endwall. The snap-down top's underside has a flexible rubber seal circumferencing the inside outer corner, for when locked into position this will prevent cleaning solution leakage. The snap-down top's underside middle has an attached square rubber piece open and slotted in its middle for holding and cleaning drywall taping knives. The holders used for all accessories; belt loop, screwdriver, tape and sheetrock knife is molded out a thermoplastic compound or suitable substance and attached to the tub device.

2 Claims, 3 Drawing Sheets

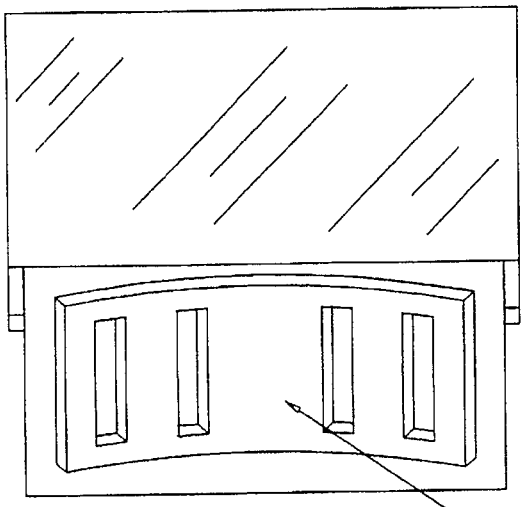
FIG. 5
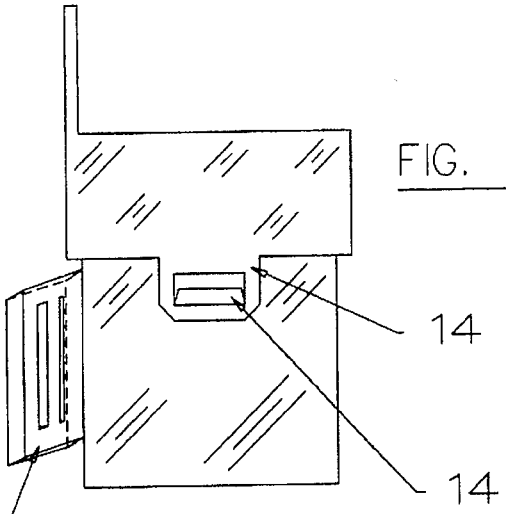
FIG. 4
17
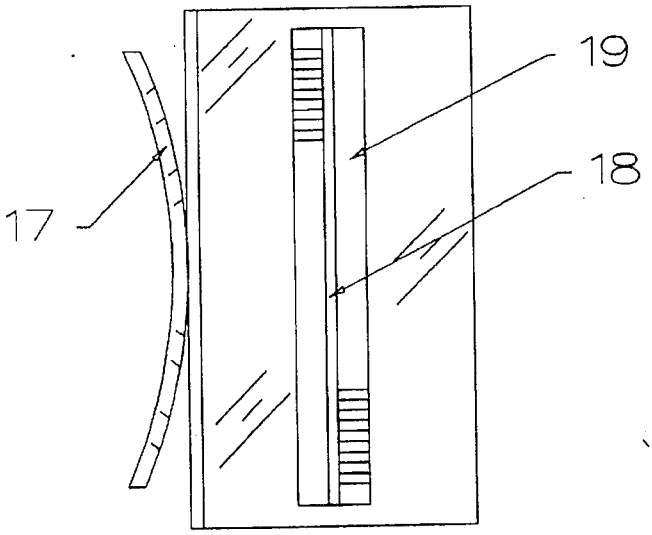
FIG. 6
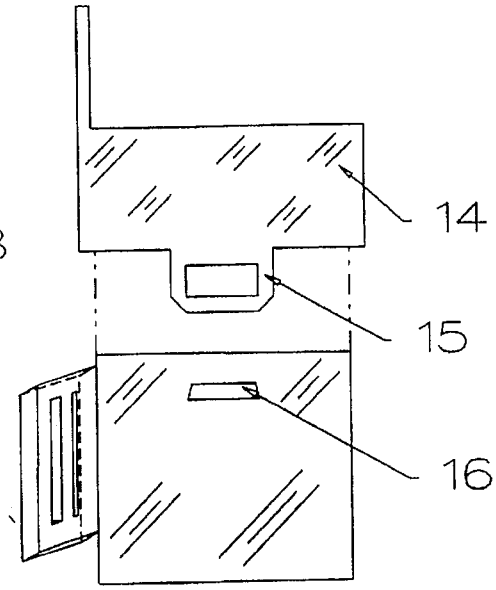
FIG. 7
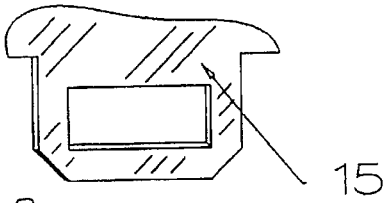
FIG. 8
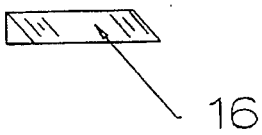

FIG. 9
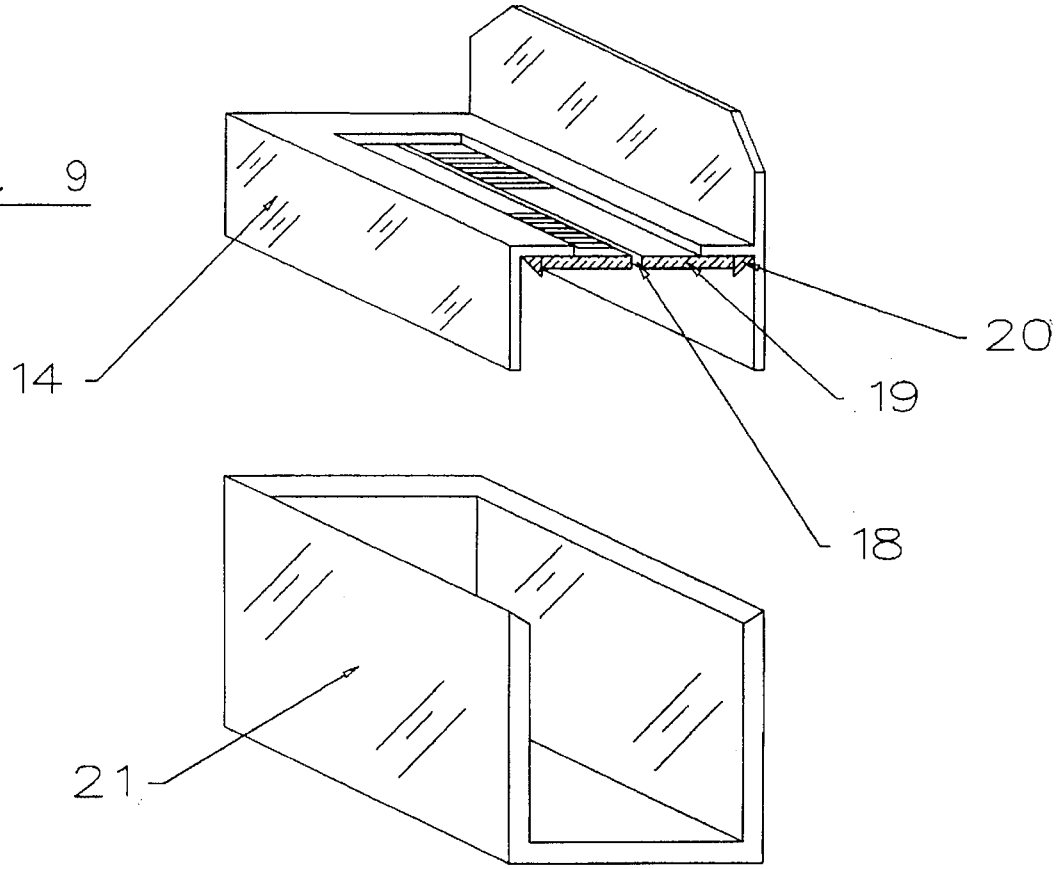
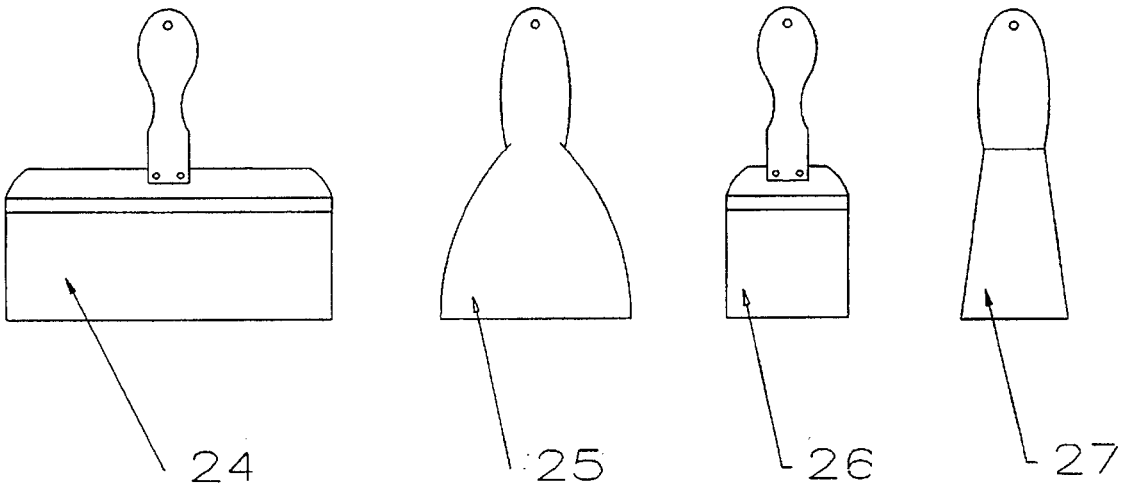
FIG. 10

DRYWALL PAK

BACKGROUND OF INVENTION

The invention relates to a new, original and practical cleaning and holding Drywall device that is attached to a Drywall Craftsman belt. Drywall Craftsman provide the skills needed to apply the compound cement and drywall tape over sheetrock seams, screw holes and corners. They prepare sheetrock walls to a finished state for painting, wallpapering, paneling, etc. Common problems Drywall Craftsman have during the procedure of drywalling is having all accessories on their person that are needed which include: various size drywall taping knives, water to keep the taping knives clean and moist for proper tool performance, a screwdriver that is needed for setting screws left above the surface, drywall tape used over sheetrock seams and corners, a sheetrock knife used for cutting excess sheetrock. Previously, a Drywall Craftsman would lose costly time locating the many accessories needed to perform the drywall task, such as, walking to and from a bucket of water to clean and moisten trowels, locating the many different sized drywall taping knives needed during the procedure and locating a screwdriver, drywall tape and sheetrock knives.

The instant invention provides the Drywall Craftsman with a device that is attached to his/her belt which enables the craftsman to carry on his/her person a tub with a snap-down lid to clean drywall taping knives through a rubber squeegee, and have attachments to hold all the accessories needed to perform the drywall task.

SUMMARY OF THE INVENTION

It is therefore an object of the invention to provide an inexpensive device to hold the many drywall tools and accessories needed for performing a drywalling task.

A further object is to provide a cleaning device that is compact and is readily positioned on a Drywall Craftsman belt for repeated cleaning, moistening and holding of many drywall taping knives for a professional performance.

A further object is to have three attachment holders for accessories needed to perform the drywall task. A holder for a screwdriver, sheetrock knives and drywall tape.

A further object is to provide the Drywall Craftsman with a top to the device that can easily be snapped down or pulled off for easy cleaning of the tub or filling of a cleaning solution.

Further and additional objects will appear from descriptions accompanying the drawings and appended claims.

BRIEF DESCRIPTION OF THE DRAWINGS

FIG. 4: A side view of the device showing the belt attachment, the snap-locks and the body guard.

FIG. 5: A view of the belt attachment and the body guard.

FIG. 6: A top view showing the slot for cleaning and holding the taping tools.

FIG. 7: A side view of the snap-down top and the locks for holding the top in place.

FIG. 8: A view of the snap-locks for holding the top in place.

FIG. 9: A view of the device cut in half to show the seals for the lock down top, this also shows the rubber material with the slot to be used for cleaning and holding the taping tools and the hollow tub that is filled with water for cleaning.

FIG. 10: A view of the drywall taping knives to be used with my drywall device.

DETAILED DESCRIPTION OF THE PREFERRED EMBODIMENT

Figure 1:
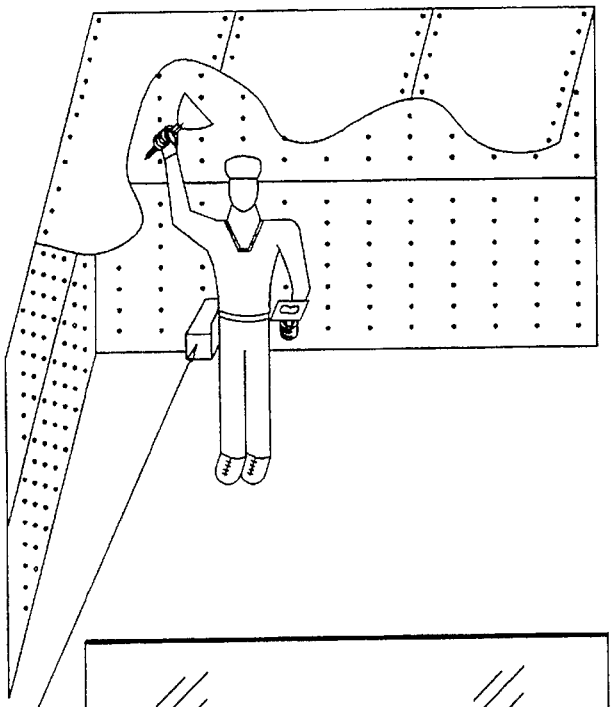
FIG. 1: A view of a Drywall Craftsman with the device attached to his belt.

Referring to the accompanying drawings;

FIG. 1 relates to a Drywall Craftsman and his working environment with the drywall device A attached to his belt.

Figure 2:
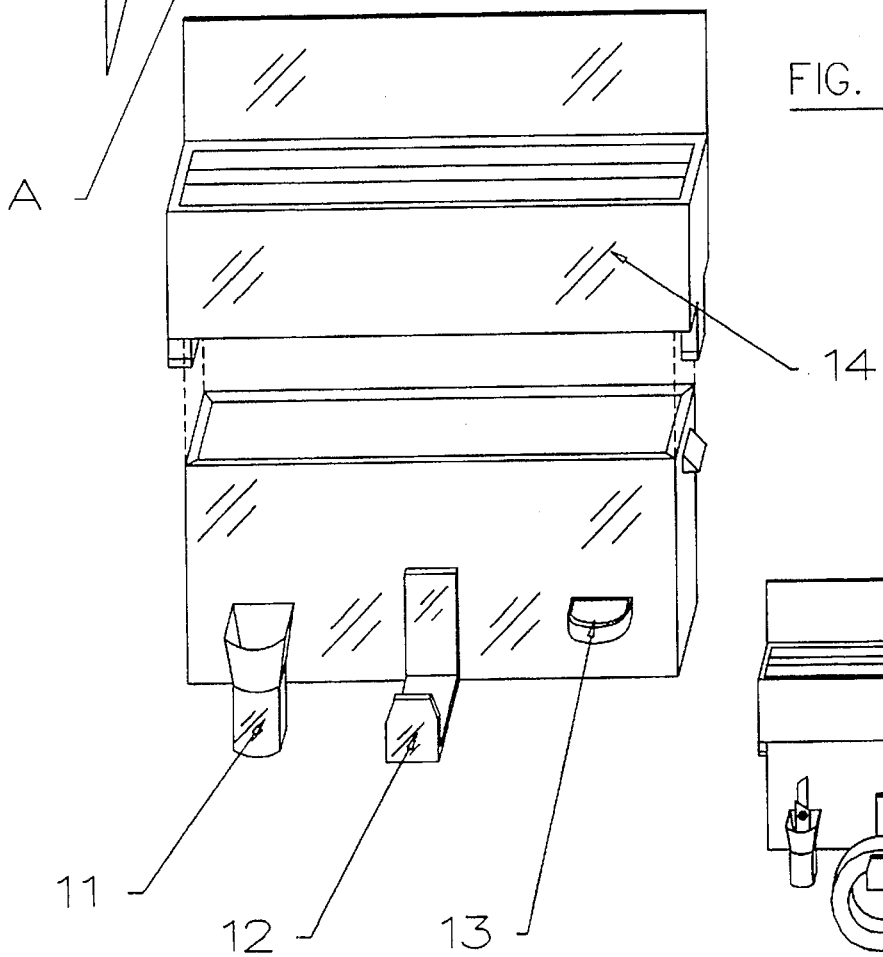
FIG. 2: An outside view of the device when attached to a Drywall Craftsman showing the snap-down top, sheetrock knife holder, drywall tape holder and screwdriver holder.
Figure 3:
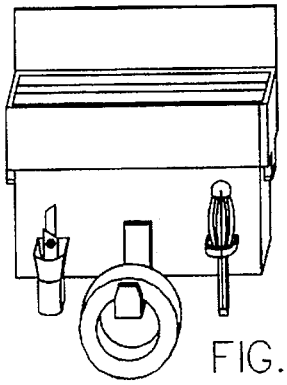
FIG. 3: A view of the device with accessories in place.

FIG. 2 is an outside view when attached to the belt of a Drywall Craftsman showing sheetrock knife holder 11, drywall tape holder 12, screwdriver holder 13 and snap-down top 14. FIG. 3 shows a view of a sheetrock knife, a roll of tape, a screwdriver and how the taping trowel is slid into the device.

FIG. 4 is a side view showing the female snap-lock 15 locked onto the male locking tab 16. The side view also shows the belt attachment 17 and body guard 18.

FIG. 5 is a back view showing the belt attachment 17.

FIG. 6 is a top view showing belt attachment 17 and slotted rubber device 19 to be used for holding and cleaning taping tools.

FIG. 7 is a side view showing the snap-down top 14, the female snap-lock 15 and male locking tab 16, this view also shows body guard 18.

FIG. 8 is a view showing the female snap-down lock 15 and male locking tab 16.

FIG. 9 is a cut view of the device showing the slotted rubber device 19 used for cleaning and holding taping tools, a rubber seal 20 around the complete underside inside corner to protect cleaning solution from leaking when snap-down top 14 is locked onto the drywall tub 21. The Tub device 21 is hollow 22 and filled with water for cleaning and keeping tools wet for proper performance. The top of the tub 23 is molded at angles same as rubber seal 20 for a lock tight seal when the top is snapped on.

FIG. 10 is a view of the various drywall taping knives the craftsman will use in the device.

I claim:

1. A cleaning and holding device for drywall taping knives and accessories comprising:

a box-like tub for holding a cleaning solution;

said tub having spaced apart sidewalls and endwalls, a flat bottom wall and a snap-down lock top;

one sidewall having a belt loop attached thereto;

another sidewall having attachments for accessories attached thereto including a screwdriver holder, a drywall tape hanger and a sheetrock knife holder;

said snap-down lock top is removably attached for easy access to clean and fill said tub;

said top having spaced apart sidewalls and endwalls wherein one sidewall is at least four times as large as the other sidewall for use as a body guard to protect a user against sharp drywall knives and to keep the clothes of the user clean;

said top having an inner, peripheral, flexible rubber seal attached thereto to establish a seal between said tub and said top to prevent cleaning solution leakage when said top is attached to said tub;

said snap-down lock top includes a cut-out central portion;

said cut-out central portion contains a flat, centrally slotted rubber piece aligned with and attached thereto for holding drywall taping knives;

each endwall of said top contains one female snap-down lock; and each endwall of said tub contains a male snap-lock tab attached thereto to accept each female snap-down lock.

2. The device of claim 1 wherein said accessory attachments are molded from a thermoplastic compound; and said belt attachment is molded from a thermoplastic compound substance.

* * * * *